United States Patent [19]

Dirks

[11] 3,988,952

[45] Nov. 2, 1976

[54] PORTABLE AND POWERABLY ACTUATABLE PIPE WRENCH

[76] Inventor: Arthur A. Dirks, 5357 N. 47th St., Omaha, Nebr. 68104

[22] Filed: Dec. 15, 1975

[21] Appl. No.: 640,423

[52] U.S. Cl. ..... 81/126; 81/183; 81/57.21

[51] Int. Cl.[2] ..... B25B 13/48; B25B 17/00

[58] Field of Search ..... 81/53 A, 57.21, 57.3, 81/57.33, 126, 129, 183; 269/228

[56] References Cited

UNITED STATES PATENTS

| | | | |
|---|---|---|---|
| 1,155,673 | 10/1915 | Moore | 81/126 |
| 1,373,861 | 4/1921 | Briles | 81/126 |
| 1,385,506 | 7/1921 | Taylor | 81/126 |
| 2,478,935 | 8/1949 | Moritz et al. | 81/57.3 |
| 2,536,463 | 1/1952 | Ratliff | 81/126 |

FOREIGN PATENTS OR APPLICATIONS

| | | | |
|---|---|---|---|
| 378,098 | 9/1907 | France | 81/126 |

*Primary Examiner*—James L. Jones, Jr.
*Assistant Examiner*—James G. Smith
*Attorney, Agent, or Firm*—George R. Nimmer

[57] ABSTRACT

Disclosed herein is a portable pipe wrench comprising a relatively stationary main frame including a rearwardly extending elongate handle and a forwardly disposed power train having a pair of roughened spurs for securely engaging and rotating a pipe segment and a nipple which is powerably actuatable by a suitable external torque-producing driver means. The portable pipe wrench also comprises a relatively movable jaw member slidably associated with the frame member and including a pair of idler wheels cooperating with the two spurs to rotatably manipulate the securely engaged pipe and further comprises a locking-adjusting assembly for the movable jaw relative to the main frame and the pipe. The main frame, the movable jaw, and the locking-adjusting assembly include several novel features which facilitate the task of securely engageably grasping and rotating the threaded pipe segment.

5 Claims, 4 Drawing Figures

PORTABLE AND POWERABLY ACTUATABLE PIPE WRENCH

Piping systems for conveying fluids comprise a series of elongate pipe segments held together by intervening threaded couplings. During the maintenance and repair of such piping systems it is oftentimes required to temporarily remove an elongate pipe segment utilizing a pipe wrench, but which task is commonly frustrated because the neighboring threaded couplings have become corroded or otherwise nonyielding to the torque manually applyable to the pipe segment by conventional pipe wrenches. Accordingly, recent prior art workers have developed more sophisticated pipe wrenches, as exemplified by U.S. Pat. Nos. 3,706,243 and 3,875,826, but which are particularly adapted for the special exigiencies of oil well piping systems. These and other recently developed pipe wrenches are not well adapted for use by general maintenance workers whose task it is to service and repair piping systems of factories and commercial and residential buildings.

It is accordingly the general object of the present invention to provide an improved portable, reliable, and economical pipe wrench which is powerably actuatable by portable torque-producing driver means and which will securely and reliably engage the pipe segment to be rotated whereby such portable pipe wrench is appropriate for use by maintenance and repairmen of most commonly encounted fluids piping systems.

With this general objective in view, and other and further objectives and advantages which will become more apparent as this description proceeds, the portable and powerably actuatable pipe wrench of the present invention generally comprises: a relatively stationary frame member including a horizontally longitudinally rearwardly extending handle and a forward depending frame-shank carrying a power train including a pair of vertically aligned roughened spurs for securely engaging and rotating a pipe segment and a nipple which is powerably actuatable by a suitable external torque-producing driver means; a relatively movable jaw member longitudinally slidably associated with the frame member and including a depending jaw-shank having a pair of vertically aligned pipe-engaging idler wheels whereby the two driving spurs and the two idler wheels are all simultaneously securely engageable with the transversely extending pipe to be rotated; and a locking-adjusting assembly for the movable jaw relatively to the frame member (and thus also for the pipe segment therebetween) and comprising; a unitary bifurcated lever having an elongate rearward tubular barrel portion and having a dual-tines bifurcated forward portion pivotably attached with a lug-pin to an upwardly extending medial lug of the frame member, a pillow-block extending between the lever tines, an elongate longitudinal adjusting screw threadedly engaged with the pillow-block, and a pair of elongated transversely separated links with the fore-end of each link pivotably attached to the jaw member with a pivot-pin permanently located in elevation below the lug-pin and with the rear-end of each link pivotably attached to the pillow-block with a pivot-rod located in elevation below the lug-pin when the entire lever is in fully downward pivoted (and temporarily locking position) from the lug-pin.

In the drawing, wherein like characters refer to like parts in the several views, and in which.

Figure 1:
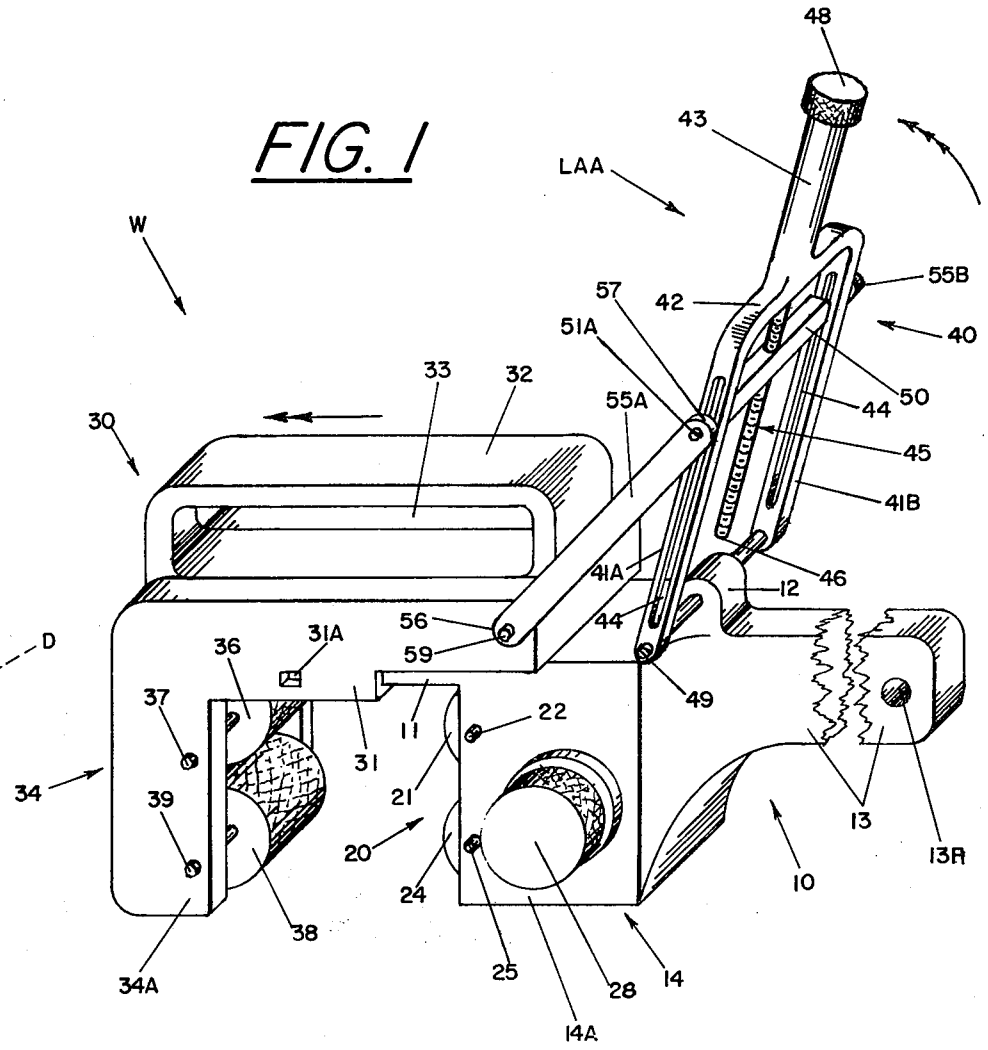
FIG. 1 is a perspective view of a representative embodiment of the portable and powerably actuatable pipe wrench of the present invention.

The portable and powerably actuatable pipe wrench concept of the present invention, as illustrated by representative embodiment "W" thereof, generally comprises a relatively stationary frame member 10 including an upstanding medial lug 12 and an elongate handle 13, a frame-shank 14 extending downwardly and forwardly of the rearward handle and carrying a power train 20 including a pair of vertically aligned pipe-engaging roughened spurs 21 and 24 which spurs are simultaneously driveable through a nipple 28 by an external driver means D; a relatively movable jaw member 30 that is longitudinally horizontally slidably associated (e.g. along frame rail 11) with the upper forward portion of the frame member, the jaw member including a depending jaw-shank 34 and carrying a pair of vertically aligned pipeengaging idler wheels 36 and 38 which cooperate with spurs 21 and 24 to rotate a pipe segment P; and a locking-adjusting assembly LAA comprising as the main components a bifurcated dual-tines lever (40) having a barrel rearward part 43 and with a lug-pin 49 pivotably connecting the lever tines 41A and 41B to the frame medial lug 12, a pillow-block 50 located between the lever tines, an elongated adjusting screw 45 threadedly engaged through the pillow-block and equipped with a rearward thumbscrew 48, and a pair of elongate links 55A and 55B with the fore-ends 56 pivotably attached (e.g. pivot-pin 59) to the movable jaw at an elevation below the lug-pin 49 and with the rear-ends 57 pivotably associated e.g. pivot-rods 51A and 51B with the pillow-block.

Relatively stationary frame member 10 has along the upperside thereof an upstanding meadial lug 12 and an elongate handle 13 (herein having transverse opening 13A) extending horizontally longitudinally rearwardly therefrom. Providing the preferred means for longitudinally slidably associating the movable jaw 30 to the frame member, the upperside of frame 10 herein includes an elongate rail 11 extending horizontally longitudinally forwardly of medial lug 12. Extending downwardly and forwardly of rearward handle 13, frame 10 includes a depending frame-shank 14 having transversely separated walls 14A and 14B whereby there is a frame cavity 15 within which is carried the power train 20. For purposes of rigidity, the frame handle 13, lug 12, rail 11, and depending shank 14 are all formed of monolithic structural material, preferably metallic.

Figure 4:
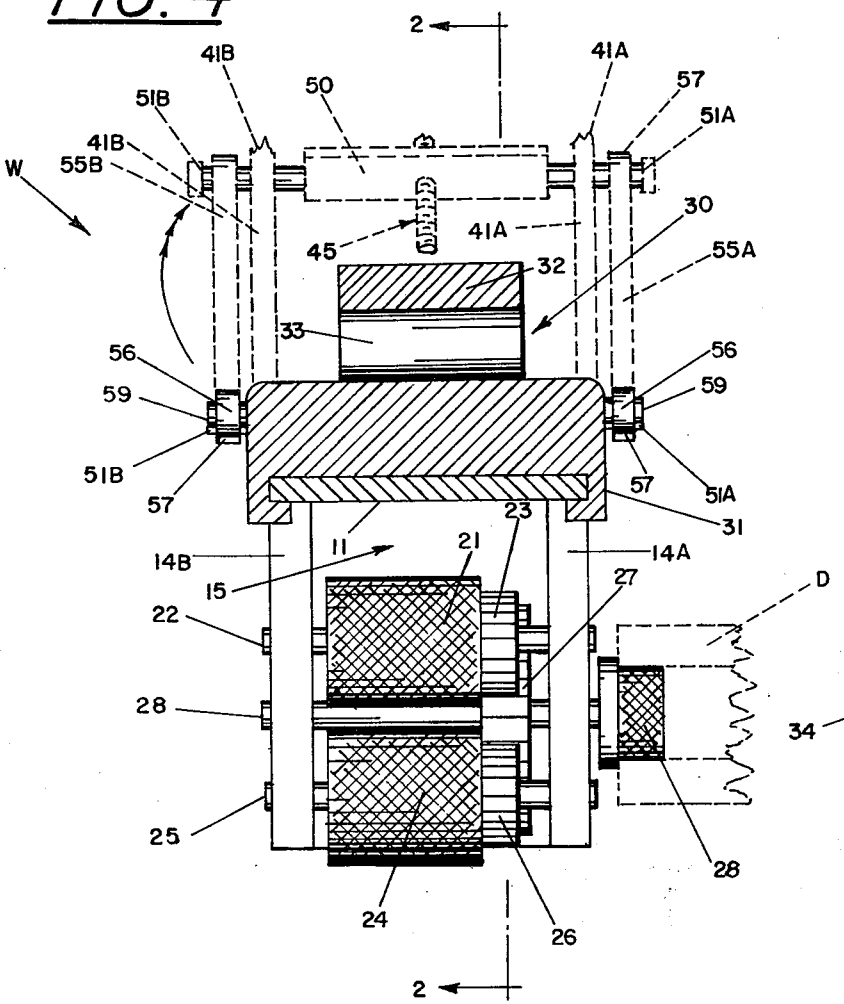
FIG. 4 is a sectional elevational view taken along lines 4—4 of FIGS. 2 and 3.
Figure 3:
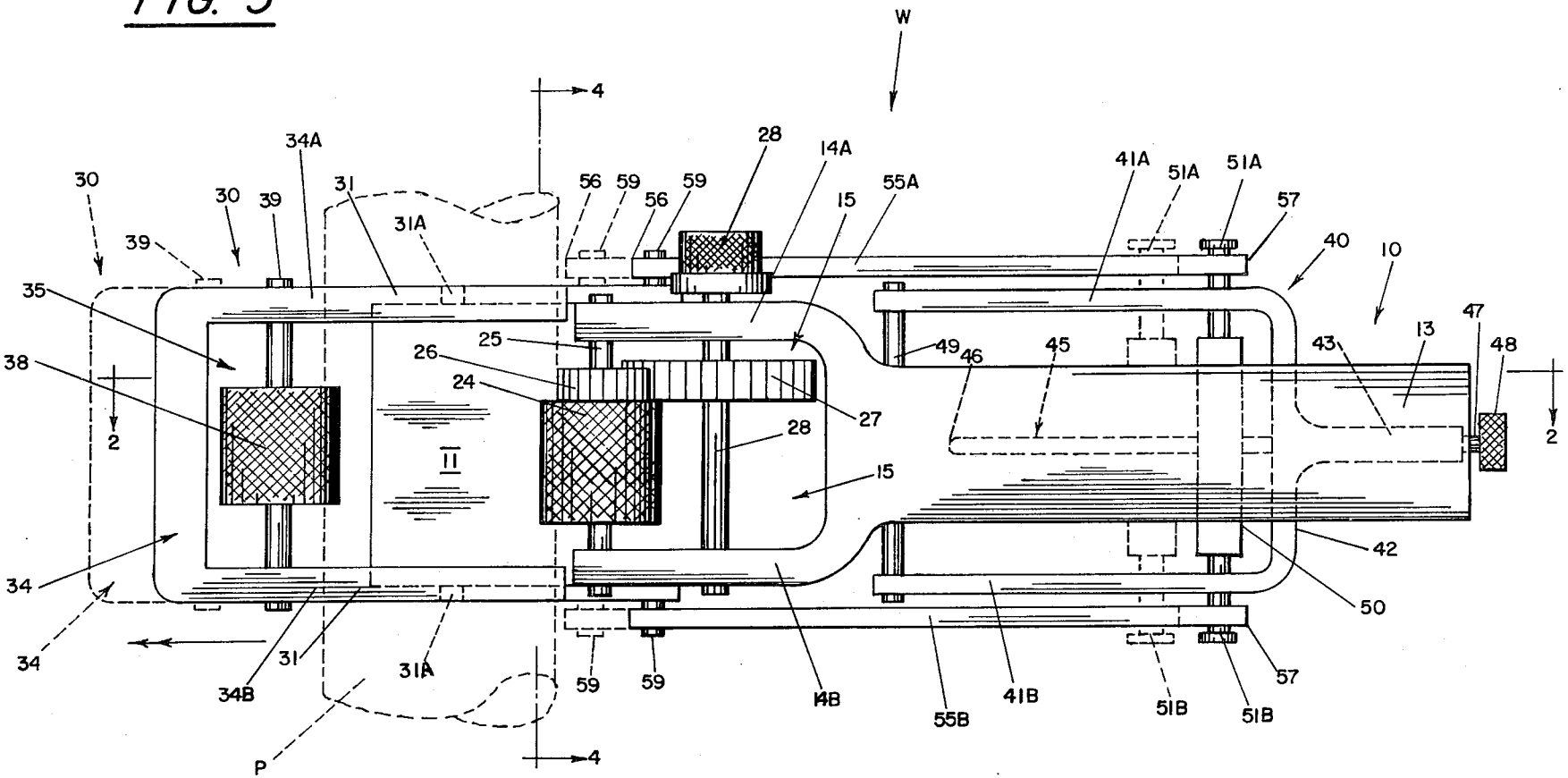
FIG. 3 is a bottom plan view of the FIG. 1 representative embodiment.

Power train 20 includes a pair of vertically aligned roughened pipe-engaging spurs, such as circular spurs 21 and 24 of equal diameters which are revolvably secured to frame 10 by keyed shafts 22 and 25 passing through walls 14A and 14B, spurs 21 and 24 extending forwardly of frame-shank 14. The respective spurs 21 and 24 include a monolithic pinion portion 23 and 26 whereby both spurs are simultaneously driveable in the same angular direction by driving-gear 27 which is rotatably secured to frame-shank 14 by transverse shaft-like nipple 28. Transverse nipple 28 is terminally roughened to facilitate its rotation by a conventional external torque-producing driver means D which is removably engageable with said nipple 28. For such external driver means D, one that is particularly well adapted is the so-called "RIDGID brand 700 Portable Power Drive" currently being marketed by the Ridge Tool Subsidiary (Elyria, Ohio) of the Emerson Electric Company. For use with external driver means, nipple 28 carries a co-rotatable medial stop means 29 therefor, as alluded to in FIG. 4.

Movable jaw member 30 includes an upper head portion 32 and, appropriate to a forward rail 11 on frame 10, jaw 30 includes a longitudinally horizontally rearwardly extending guide means 31 surrounding the transversely separated sides of the frame rail 11 forward portion whereby jaw 30 is longitudinally slidably associated with frame member 10. These guide means 31 are herein provided with transversely extending sighting-holes 31A so the operator can judge the longitudinal location of jaw 30 with respect to frame 10; in this vein, frame rail 11 at common elevation with sighting-holes 31A carries incrementally spaced indicia (not shown). The jaw member head portion 32 above the guide means includes a manual puller means to permit the operator to adjustably slide jaw 30 coincident with adjustment of adjusting screw 25, herein the manual puller means comprising a transversely extending enlarged opening 33. Jaw member 30 includes a jaw-shank 34 extending downwardly and forwardly of head portion 32 and comprising transversely separated walls 34A and 34B whereby there is a jaw cavity 35. For purposes of rigidity, the jaw head 32, guide means 31, and depending jaw-shank 34 are all formed of monolithic structural material, preferably metallic.

Within the jaw cavity 35 there is a pair of vertically aligned pipe-engaging roughened idler wheels 36 and 38 of equal circular diameters which are revolvably secured to jaw 30 by shafts 37 and 39 passing through walls 34A and 34B, wheels 36 and 38 extending slightly rearwardly of jaw-shank 34. Preferably, wheels 36 and 38 are of equal diameter to the spurs 21 and 24, and the shafts 37 and 22 for the upper-wheel and the upper-spur are of common elevation while the shafts 39 and 25 for the lower-wheel and the lower-spur are also of common (but lower) elevation.

Locking-adjusting assembly LAA principally comprises a bifurcate lever member 40 including: a medial web portion 42, a pair of parallel elongate tines 41A and 41B extending longitudinally forwardly of web 42, and an elongated tubular barrel rearward portion 43 having an axial bore extending longitudinally therealong. For the preferred embodiment, each of the lever tines 41A and 41B is provided with a longitudinally extending slot-like opening 44 which extends the major length between lug-pin 49 and lever web 42. The forward part of each lever tine is pivotably attached to the frame member upwardly extending lug 12 with a transversely extending lug-pin 49. When lever 40 is pivoted fully downwardly about lug-pin 49, it preferably firmly abuts the upperside of frame handle 13 which promotes safe and reliable manipulation thereat by the operator.

The locking-adjusting assembly LAA also includes a pillow-block 50 transversely extending between (but structurally separated from) the lever tines 41A and 41B. There is an elongate adjusting screw 45 extending through said lever tubular barrel 43 and web 42 and threadedly engaged through pullow-block 50. Elongate adjusting screw 45 includes a forward nose-end 46 located forwardly both of lever web 42 and pillow-block 50 and also a rearward tail-end 47 located rearwardly of barrel 43. Integrally attached to the adjusting screw tail-end 47 and located a finite distance rearwardly of lever barrel 43 is an enlarged thumbscrew 48 of roughened surface configuration.

Figure 2:
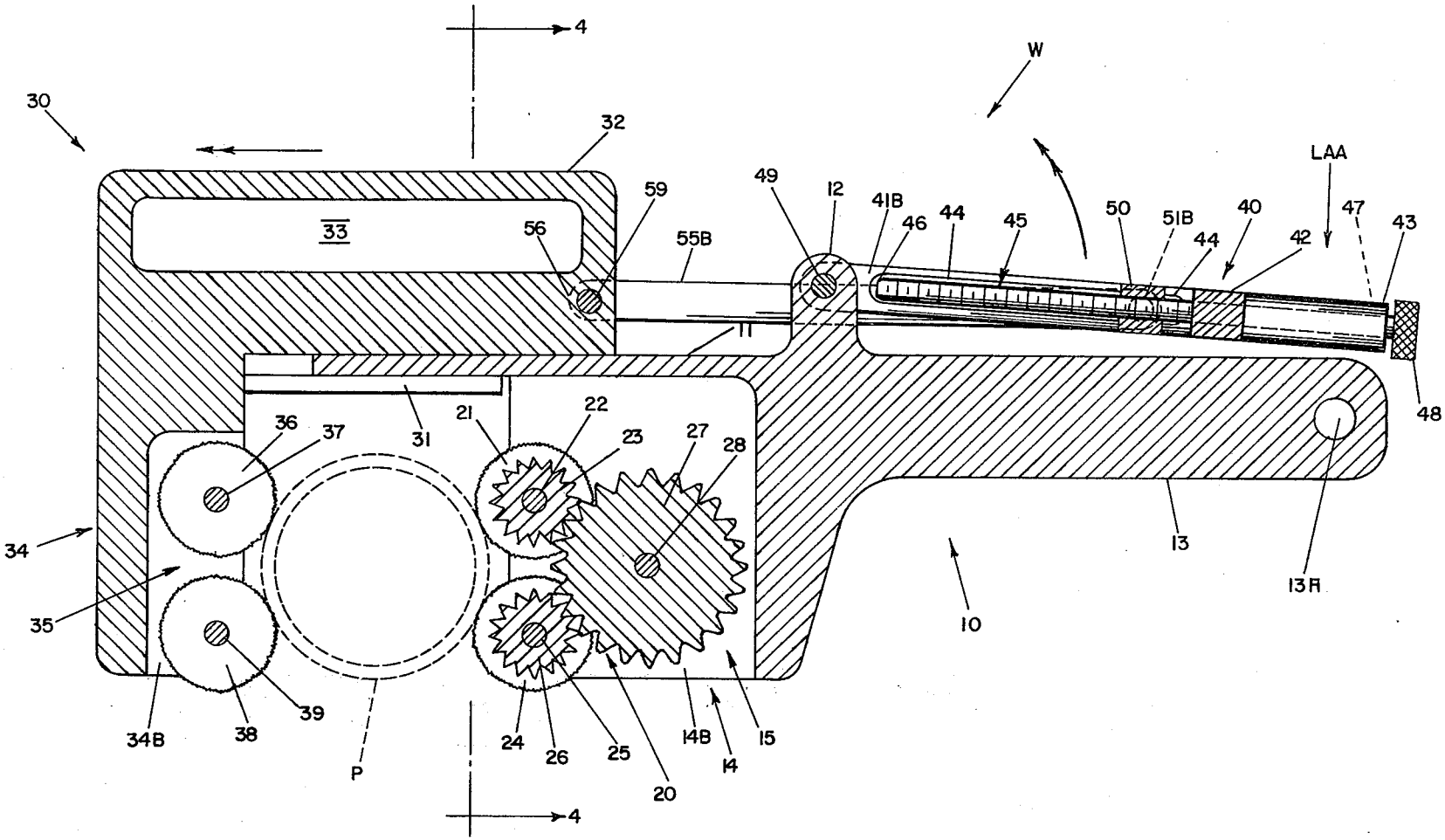
FIG. 2 is a sectional elevational view taken along lines 2—2 of FIGS. 1, 3, and 4.

Assembly LAA also includes a pair of elongated transversely separated parallel links 55A and 55B, each link having a fore-end 56 pivotably attached to the jaw head portion 32 with a transversely extending pivot-pin 59 which is permanently located in elevation below the lug-pin 49. Each of the elongate links 55A and 55B has a rearend 57 pivotably attached to the pillow-block 50 (remotely of the threadedly associated screw 45) with transversely extending pivot-rod means e.g. 51 which is located in elevation below the lug-pin 49 whenever the lever 40 is pivoted fully downwardly about lug-pin 49 as indicated in FIG. 2. However, the pivot-rod means 51 is locatable in elevation above lug-pin 49 and pivot-pin 59 when lever 40 is pivoted upwardly about lug-pin 49 as indicated in FIG. 1. Herein the two elongate parallel links 55A and 55B are transversely separated by the two parallel lever tines 41A and 41B whereby all four said longitudinal members (41A, 41B, 55A and 55B) are parallel thereby greatly enhancing the structural strength for pipe wrench W. In this vein, the links' rear-ends 57 are pivotably attached to pillow-block 50 with a pair of transversely extending headed pivot-rods 51A and 51B respectively passing through the tine slots 44. Thus, it can be seen that as lever 40 is made to pivot upwardly about lug-pin 49 as indicated by triple-headed curved arrows, jaw member 30 is forced to slide longitudinally forwardly away from frame 10 and pipe segment P as indicated by double-headed straight arrows.

Operation of the pipe wrench W, although having already been alluded to, might be summarized as follows. First, the operator pulls longitudinally forwardly on jaw 30 using a puller means e.g. 33 to provide a barely sufficient space between wheels 36 and 38 and spurs 21 and 24 to accommodate pipe segment P, reliance being made coincidentally upon the sighting-holes (31A and 31B) and the thumbscrew 48. Next, the operator pivots lever 40 downwardly about lugpin 49 so that lever 40 abuts the upperside of frame handle 13, and thence adjustably turns thumbscrew 48 so that maximum pressure is caused to bear securely against pipe P by wheels 36 and 38 and spurs 21 and 24. At this locking stage, pivot-rod means 51 and pivot-pin 59 are both located in elevation below lug-pin 49 as indicated in FIG. 2. Then, the operator utilizes a driving means D to rotate the spurs 21 and 24 and also pipe segment P to threadedly disengage same from its endward coupling (not shown); coincidentally, the operator steadies the wrench W from counter-rotation by seizing lever lever barrel 43 and handle 13 together and perhaps supplemented by additional counter-rotational leverage forces applied to the handle at 13 or 13A. Upon such desired driven rotation of pipe segment P, the operator lifts upwardly upon lever 40 as indicated by triple-headed curved arrow in FIG. 2 and shown in FIG. 1 whereby jaw 30 moves forwardly away (i.e., double-headed straight arrow) and becomes disengaged from the pipe segment.

From the foregoing, the construction and operation of the portable and powerably actuatable pipe wrench concepts herein will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. A portable and powerably actuatable pipe wrench and comprising:

A. A relatively stationary frame member having along the upperside thereof an upstanding medial lug and an elongate handle extending horizontally longitudinally rearwardly therefrom, a frameshank extending downwardly and forwardly of the frame handle and carrying a power train including a pair of vertically aligned pipe-engaging spurs including an upper-spur and a lower-spur that extend forwardly of the frame-shank and a transversely horizontally extending nipple, said power train being powerably actuatable by a suitable external driver means that is removably engageable with said nipple;

B. A relatively movable jaw member including a head portion longitudinally horizontally slidably associated with the upper forward portion of the frame member, the jaw member including a jaw-shank extending downwardly and forwardly of the head portion and carrying a pair of vertically aligned pipe-engaging idler wheels that extend rearwardly of the jaw-shank whereby the two spurs and the two wheels are all simultaneously engageable with a transversely extending pipe to be manipulated; and C. A locking-adjusting assembly for said movable jaw relative to said stationary frame and transverse pipe therebetween and comprising:

i. a unitary bifurcated lever including a medial web portion, a dual-tines bifurcate forward portion, and an elongated tubular barrel rearward portion having a bore extending forwardly through the lever medial web, the forward part of each lever tine being pivotably attached to the frame member upwardly extending medial lug with a transversely extending lug-pin;

ii. a pillow-block extending transversely between but transversely spaced from the tines;

iii. an elongated adjusting screw engaged with the pillow block, said adjusting screw including a forward nose-end located forwardly of the lever web and the pillow-block and a rearward tail-end located rearwardly of the lever barrel and to which tail-end is attached an enlarged thumb-screw; and iv. a pair of elongated transversely separated links, each link having a fore-end pivotably attached to the jaw head portion with a transversely extending pivot-pin permanently located in elevation below the lug-pin, each link having a rear-end pivotably attached to the pillow-block remote of the adjusting screw with a transversely extending pivot-rod located in elevation below the lug-pin when the entire lever is pivoted fully downwardly about said lug-pin but located in elevation above said lug-pin when the entire lever is pivoted upwardly about said assembly pivot-pin.

2. The pipe wrench of claim 1 wherein the frame member upperside at the forward end includes a longitudinally horizontally extending elongate rail; wherein the jaw member lower portion includes a rearwardly extending guide means surrounding and longitudinally slidably associated with the forward portion of the frame member horizontal rail; wherein each of the lever tines is provided with an elongated slot; wherein the two elongate links are transversely separated by the two lever tines; and wherein the pivot-rod connection between links and pillow-block passes transversely through the tines elongated slots.

3. The pipe wrench of claim 2 wherein the two spurs and the two idler wheels are of roughened surface configuration to facilitate pipe manipulation; wherein the power train includes a gear connection between nipple and the two spurs; wherein the lever tubular barrel is downwardly abuttable against and thereat extends rearwardly beyond the frame member handle upperside; wherein there is a pair of transverse pivot-rods extending through the respective slotted links is employed to connect the respective elongate links to the pillow-block; and wherein the jaw member guide means is provided with a transversely extending sighting-hole and at common elevation with the surrounded frame member rail, said jaw member head portion above the guide means being provided with manual puller means.

4. The pipe wrench of claim 1 wherein the two spurs and the two idler wheels are of roughened surface configuration to facilitate pipe manipulation; wherein the power train includes a gear type connection for driving both spurs simultaneously; and wherein the lever tubular barrel is downwardly abuttable against and thereat extends rearwardly beyond the frame member handle upperside.

5. The pipe wrench of claim 4 wherein each of the lever tines is provided with an elongate slot; wherein the two lever tines and the elongated adjustment screw extend longitudinally and substantially coparallel; wherein the two elongate links are transversely separated by said lever tines; and wherein there is a pair of transverse pivotrods extending through the respective slotted links employed to connect the respective elongate links to the pillow-block.

* * * * *